US005183206A

United States Patent [19]

Gavin

[11] Patent Number: 5,183,206

[45] Date of Patent: Feb. 2, 1993

[54] SPRAY NOZZLE

[76] Inventor: Daniel J. Gavin, 7873 Kellogg Creek, Mentor, Ohio 44060

[21] Appl. No.: 710,560

[22] Filed: Jun. 5, 1991

[51] Int. Cl.[5] ..... B05B 7/28; B05B 1/26

[52] U.S. Cl. ..... 239/317; 239/500; 239/521; 239/522

[58] Field of Search ..... 239/310, 317, 318, 340, 239/343, 432, 499, 500, 501, 502, 521, 522, 523, 524; 222/630; 366/163, 336, 337, 340

[56] References Cited

U.S. PATENT DOCUMENTS

| | | | |
|---|---|---|---|
| 1,179,905 | 4/1916 | Englemann | 239/521 |
| 1,976,506 | 10/1934 | Maurer | 239/310 |
| 2,789,010 | 4/1957 | Dean | 239/310 |
| 2,991,939 | 7/1961 | Packard | 239/310 |
| 3,254,844 | 6/1966 | Blasnik et al. | 239/310 |
| 3,323,685 | 6/1967 | Schultz | 222/630 |
| 4,067,498 | 1/1978 | Holcomb | 239/521 |
| 5,100,059 | 3/1992 | Englhard et al. | 239/310 |

FOREIGN PATENT DOCUMENTS 401506 11/1922 Fed. Rep. of Germany ..... 239/502

*Primary Examiner*—Andres Kashnikow
*Assistant Examiner*—Christopher G. Trainor
*Attorney, Agent, or Firm*—Fay, Sharpe, Beall, Fagan, Minnich & McKee

[57] ABSTRACT

A spray nozzle for spreading soluble and non-soluble substances contained within a canister. An inputted fluid flow is divided into a first partial flow to create a slurry within the canister, and a second partial flow which enters a mixing chamber to, in turn, create a venturi effect drawing into the mixing chamber portions of the slurry. An outlet channel deflector reflects the second partial fluid flow against the bottom surface of a flared nose at an exhaust end of the spray nozzle. A combination of two removable discs provides for conversion between use with soluble and non-soluble particles including grass seed, fertilizer, or the like.

34 Claims, 5 Drawing Sheets

SPRAY NOZZLE

BACKGROUND OF THE INVENTION

The present invention relates to the art of liquid spray applicators and more particularly to liquid seed applicators. It finds particular application in conjunction with soluble products or non-soluble products, such as grass seed or the like, and will be described with particular reference thereto. However, it will be appreciated that the invention has broader applications such as pelletized fertilizer applications or other uses where it is desired to spread fine solid particles evenly over a surface, and as such may be advantageously employed in other similar environments and applications.

Simple liquid spray applicators are well known in the art and generally utilize a venturi effect, which phenomena is generally described as a reduction in pressure with increasing fluid velocity. Static pressure is exerted on all fluids at rest, the pressure being uniform at all points in a given plane. By the principle of conservation of energy, moving fluids possess kinetic energy by virtue of the movement. Liquid spray applicators take advantage of the principles of the venturi effect to spray a concentrate contained in a reservoir at barometric pressure (static pressure) as a diluted atomized mixture by passing a high velocity input fluid over a capillary tube end to draw the concentrate from the reservoir and out the tube end into the input flow. To maintain static barometric pressure within the container, the reservoir is typically provided with a bleeder passage for input of air at atmospheric pressure.

As one would expect, the liquid spray applicators eventually evolved to include the ability to apply water-soluble products such as, for example, fertilizers or the like. Devices which suggest the capability of spraying soluble products include Gatchet U.S. Pat. Nos. 1,769,428, 1,848,708, and 2,601,672, Flanders U.S. Pat. No. 2,536,361, Roberts U.S. Pat. No. 2,682,428, Elvers, Sr. U.S. Pat. No. 3,123,362, Garrett U.S. Pat. No. 3,165,114, and Dulger U.S. Pat. No. 3,421,738.

According to the spray nozzles available for the application of water-soluble products listed above, an input fluid flow is divided into two partial flows, a first of which is made to mix with a water-soluble solid contained in a reservoir. The mixture in a liquid form escapes the reservoir and combines with a second partial flow in a mixing chamber. As such, a limitation on the rate of application of the contained water-soluble solids is for the most part determined by the rate at which the soluble products can be made to dissolve. In this regard, the use of insoluble products tend to quickly clog the particularly metered orifices of the above-named devices, requiring constant attention to maintaining those passages free from obstruction.

Recently, attempts have been made to develop products for the application of solids in the form of seed or the like. Devices currently offered as being fit for those purposes include Gunlock U.S. Pat. Nos. 4,809,913 and 4,913,356.

Referring to the general principals of operation behind liquid seed applicators available today, an inlet chamber is typically provided for receiving an input fluid flow from a source such as a garden hose. The inlet chambers are typically provided with two exhaust passages including an approach passage having a reduced cross-sectional area and a smaller passage forming an inlet into a reservoir containing seed. The approach passage in turn connects the inlet chamber with a mixing chamber. Within the mixing chamber, the slurry created by the inputted fluid received through the smaller passage and combined with the seed is mixed with the inputted fluid which flows through the approach passage. Lastly downstream, a nozzle is provided for limited control over the resultant spray pattern.

Although the above liquid seed applicators have met with limited success, practical testing of the designs available today, including the designs according to the teachings above, indicates that those devices are extremely limited and promise to clog frequently preventing some portion of the seed from entering the water flow for distribution. With particular reference to the Gunlock patents listed above, it is apparent that the output nozzle is limited to providing only a generally round and concentrated spray pattern which is in most cases inappropriate for providing a desirable even distribution of seed. More particularly, the constrictive output nozzle in effect narrows the mixing chamber, which in turn encourages frequent clogging of the slurry rendering the unit inoperable and/or overflow the container due to over-pressurizing of the unit.

The present invention contemplates a new and improved convertible spray nozzle for use with both water soluble and insoluble products which overcomes the clogging problems heretofore commonly associated with liquid seed applicators, yet while providing for a wide and even pattern distribution of seed or dissolved products.

SUMMARY OF THE INVENTION

In accordance with the present invention, a convertible spray nozzle is provided for application of both soluble and non-soluble materials over a surface. The convertible spray nozzle comprises an inlet end, a distribution section, a mixing section, and an exhaust end. Fluid, such as water, is received into a primary chamber located at the inlet end. The inputted fluid is then divided into two partial flows while within the distribution section. The first partial flow is directed to a canister coupled to the nozzle and provided with the soluble or non-soluble application materials. The second partial flow is directed to a mixing chamber. The mixing chamber is open to the slurry created within the canister whereby the passing of the second partial flow through the mixing chamber draws the slurry from the canister and through an outlet channel for distribution at the exhaust end taking advantage of the venturi principles described above.

In accordance with a more limited aspect of the present invention, the distribution section is provided with a direct fluid passage for permitting the fluids received into the secondary inlet chamber to pass therethrough confined within a predetermined longitudinal cross-sectional area. Further, the mixing section is provided with an outlet channel formed above the predetermined longitudinal cross-sectional area of fluid flow through the direct passage. An outlet channel deflector substantially deflects the portions of the fluid flow obliquely through the mixing chamber against a bottom surface of a flared nose provided at the exhaust end of the spray nozzle.

In accordance with another aspect of the present invention, a pair of discs are provided for easy conversion between soluble and non-soluble applications. A stationary disc is received into the spray nozzle housing to partially restrict a passage between the canister and the mixing chamber. The stationary disc is further provided with centering holes for receipt of positioning dimples formed on a movable disc to be described below. The movable disc is apertured having a plurality of outflow orifices of varying size to control the passage between the reservoir and the mixing chamber by means of modifying the cross-sectional area of the passage to "throttle" the flow therethrough.

In accordance with another aspect of the present invention, a method of mixing and spraying non-soluble particles using a spray nozzle is provided. A preselected ratio of an inputted fluid stream is constrained to flow through a mixing chamber and directly into an output channel deflector to thereby be deflected through an outlet channel after mixedly combining with portions of a slurry created within the mixing chamber itself. An exhaust end having a flared nose comprising guide ribs and a bottom surface creates an even flow for uniform seed distribution.

One advantage of the present invention is that seeds or other non-soluble material may be evenly distributed over a surface.

Another advantage of the present invention is that the mixing chamber is arranged to specifically discourage the clogging of the materials as they exit the reservoir and spray nozzle.

Still yet another advantage of the present invention is the ability to convert easily between use with soluble and non-soluble products contained within the reservoir.

Still further advantages of the present invention will become apparent upon a reading and understanding of the following detailed description.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
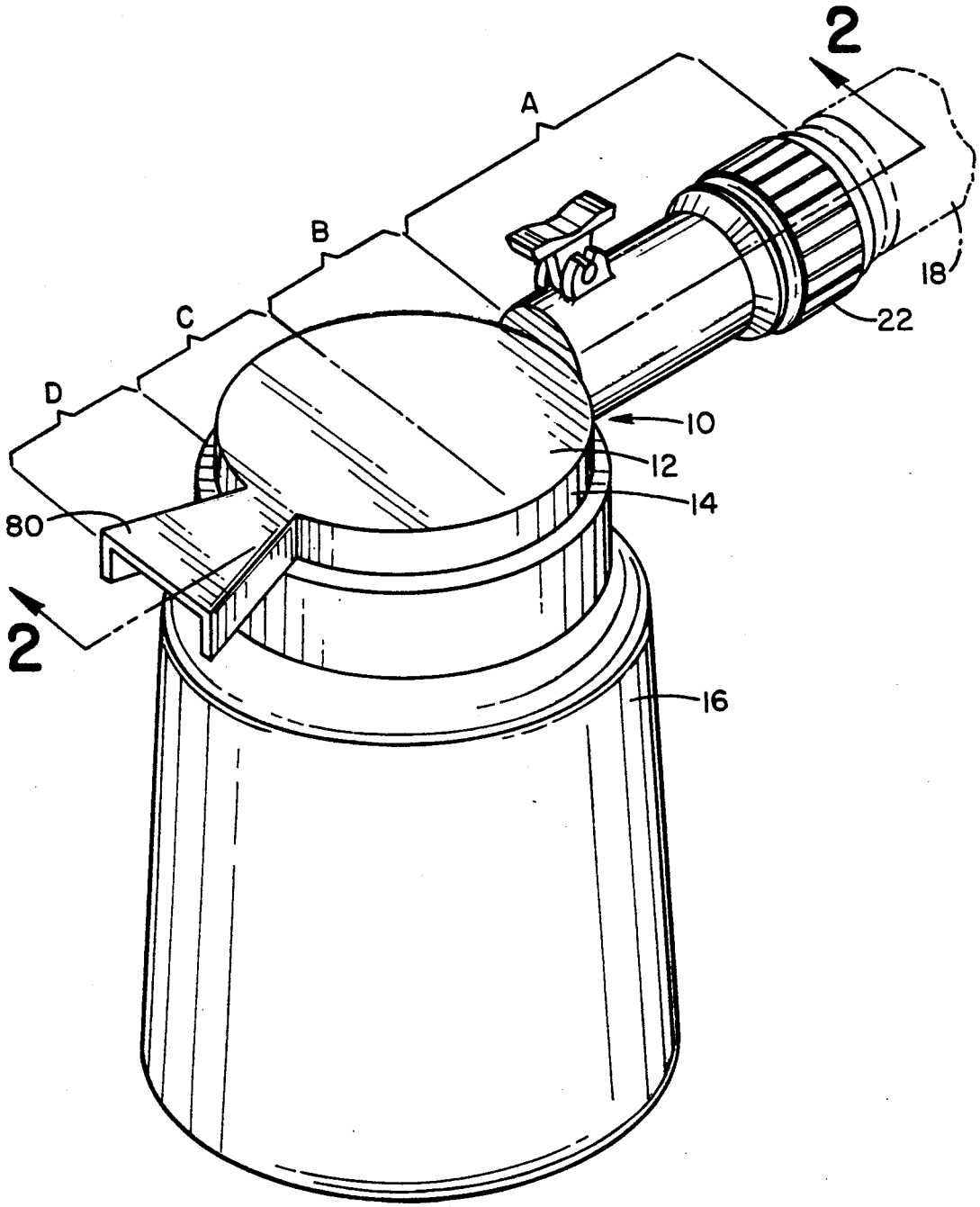
FIG. 1 is a perspective view of the spray nozzle shown attached on one end to a fluid supply hose and at another end to a canister in accordance with the present invention.

Referring now to the drawings, wherein the showings are for purposes of illustrating the preferred embodiments of the invention only and not for purposes of limiting same, the FIGURES show a convertible spray nozzle apparatus 10 capable of receiving a canister or jar 16 and a fluid supply as, for example, a garden hose 18.

More particularly with reference to FIG. 1, the convertible spray nozzle 10 is generally divided into four regions A, B, C, D. The inlet end A is adapted to receive a garden hose 18 or the like for supply of fluids such as water. An internally threaded nut 22 is received over a flared end of the spray nozzle. The distribution section B and mixing section C combine to form channels which first divide the inputted fluid into at least two partial flows and subsequently downstream recombine the divided flows along with soluble or non-soluble products from within the canister 16. The expelled combination flows through the exhaust end which forms a flared nose for control over the width of exhaust spray.

Figure 2:
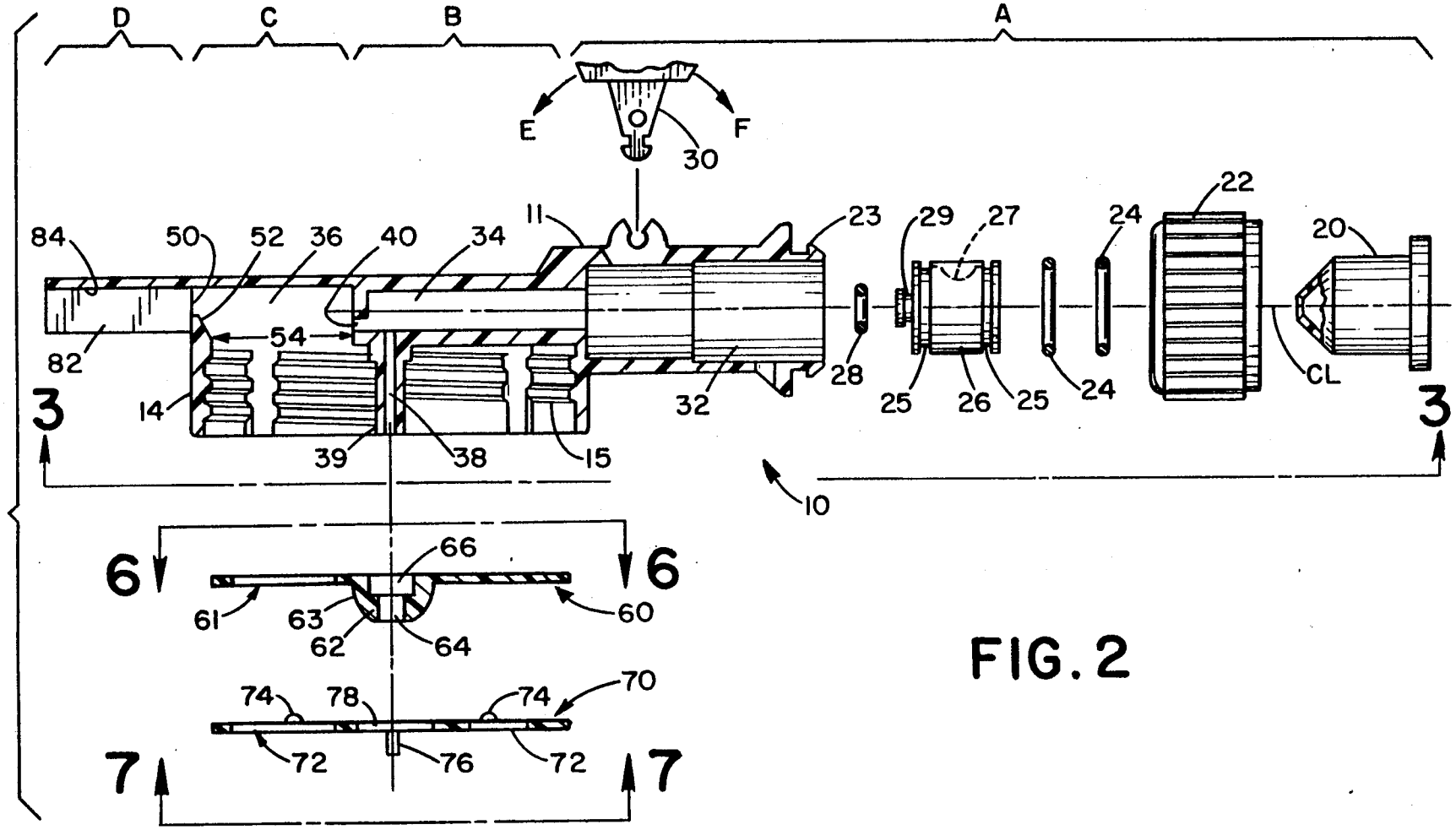
FIG. 2 is an exploded and enlarged sectional view taken along the line 2—2 of FIG. 1.

Now with particular reference to FIG. 2, the convertible spray nozzle 10 of the instant invention is shown in an exploded view along line 2—2 of FIG. 1 to expose the constituent components. The inlet end section A contains a number of individual valving parts for control over the inputted fluid stream. Fluid enters the spray nozzle lo from the right side as viewed from FIG. 2 through a one-way (uni-directional flow) valve 20. To guard against backflow into the supply fluid line and to meet code requirements in certain states, a "raspberry" valve is typically used. The raspberry valve permits the flow of fluid into the housing 11 when the pressure to the right of the valve is greater than the pressure to the left of the valve as viewed in the FIGURE. The valve 20 comprises a small slit for the passage of water therethrough, the material surrounding the slit being resiliently biased toward the closed position wherein, absent any pressure differentials, the valve slit denies the flow of fluids therethrough. A backpressure, manifested as an increasing pressure differential gradient toward the left as viewed in the FIGURE, causes the material of the valve to close the slit with a pressure greater than what exists in accordance with the bias of the material itself.

A plunger 26 is adapted to receive an O-ring 28 into a circumferential groove 29. In addition, a pair of larger circumferential grooves 25 are adapted to receive an O-ring pair 24 onto the plunger 26. The O-rings 24, 28 and plunger 26 are sized to be slideably received within a primary inlet chamber 32 of housing 11. When received as such within the chamber 32, the O-rings 24 engage the inner walls of the primary inlet chamber itself to block the flow of water around the plunger as between the plunger 26 itself and the primary inlet chamber walls. At an end of the plunger 26, O-ring 28 is accordingly sized to engage the inner walls of a secondary inlet chamber 34 when positioned to the extreme left as viewed from the FIGURE. When in such position, the combination of plunger 26 and O-ring 28, deny flow of fluids from the primary inlet chamber 32 into the secondary inlet chamber 34.

With continued reference to the inlet end section A, a portion of a trigger 30 passes through the housing 11 to engage a recess 27 within the plunger 26. Actuation of the trigger 30, as by a toggle action, serves to slide the plunger assembly 26 longitudinally within the primary inlet chamber 32. Actuation of the trigger 30 in a direction F causes the plunger assembly 26 to slide within the primary inlet chamber 32 leftwardly as viewed in the FIGURE. This has the effect of closing off fluid flow through the secondary inlet chamber 34. Conversely, actuation of the trigger 30 in a direction E longitudinally slides the plunger 26 rightwardly as viewed in the FIGURE to open or allow fluid flow into the secondary inlet chamber 34 through perforations in the plunger 26 spaced radially outward from the O-ring 28 and extending longitudinally through the plunger body.

An internally threaded nut 22 mechanically attaches a fluid supply hose such as a garden hose to the housing 11. The nut 22 grips the housing 11 by means of a ridge 23 circumferentially provided on the housing 11 as illustrated.

Referring next to the distribution section B, the secondary inlet chamber 34 forms an elongate generally cylindrical hollow section having a longitudinal axis CL, which is collinear with a longitudinal axis of the primary inlet chamber 32 in the preferred embodiment. However, the secondary chamber 34 is of considerably smaller cross-sectional area than the primary chamber, as can be seen from the FIGURE. Fluid flowing into the secondary chamber 34 escapes through one of two openings. A fill passage 38 comprises a small capillary-type passageway which directs the fluid from the secondary inlet chamber 34 into a canister (not shown) received into the housing 11 and coupled thereto as by threads 15. A direct passage 40 forms the second opening and is constrained to lie below the longitudinal axis CL of both chambers 32 and 34 as viewed from the FIGURE. Generally, fluid flowing through the secondary inlet chamber 34 exists the direct passage 40 as a directed spray according to the size of the opening 40 and below the axis CL of the inlet chambers 32 and 34. Fluid which flows through the fill passage 38 mixes with seed or other materials or substances which may be contained in the canister 16 to create a slurry.

The axis CL is used for ease of reference in the preferred embodiment, although it is to be understood by those skilled in the art that the relative positioning between the direct passage 40 and a deflector/outlet channel pair described below is primarily responsible for the advantageous results realized by the instant invention.

Next referring to the mixing section C, fluid which passes through the direct passage 40 enters a mixing chamber 36 striking an outlet channel deflector surface 52. The flow of fluid through the mixing chamber 36 and across a slurry communicating passage 54, creates a venturi effect which tends to draw the slurry present within the canister 16 into the mixing chamber 36 according to the well-known phenomenon described above. The outlet channel deflector 52 is set at an angle from the longitudinal axis above the uppermost extreme of passage 40 and common to the inlet chambers 32 and 34. The angle is 45° in the preferred embodiment. In addition, the outlet channel 50 and outlet channel deflector 52, meet at a plane defined by the longitudinal axis CL to, in effect, create a "misalignment" between the direct passage 40 and outlet channel 50. That is, fluids escaping the secondary inlet chamber 34 through the direct passage 40, must necessarily first strike the outlet channel deflector 52, before passing through the outlet channel 50. As such, it is apparent that the actual configuration of the chambers 32 and 34 may be modified to conform with any number of applications without departing from the misalignment concept described above.

In addition, the cross-sectional area of the secondary chamber 34 in a plane transverse to the axis CL is "tuned" with the area of outlet channel 50. That is, in the preferred embodiment, the chamber 34 and the channel 50 are sized to have corresponding (matching) cross-sectional areas. This arrangement results in the optimum operational characteristics in the preferred embodiment. Experimentation with sizing indicates that for a fixed cross-sectional area of secondary chamber 34, a large outlet channel 50 resulted in a "gasping" or "sputtering" of the product from the reservoir 16. For a small outlet channel 50, the inputted fluid accumulates within the reservoir 16 in turn causing threads 15 to leak the accumulated slurry.

The quantity and capacity of the expulsion of the slurry contained within the canister 16 is controlled by a selective adjustment of the slurry communicating passage 54. In the preferred embodiment, a means for controlling the aperture size of the slurry communicating passage 54 comprise a stationary disc 60 and a moveable disc 70.

Figure 6:
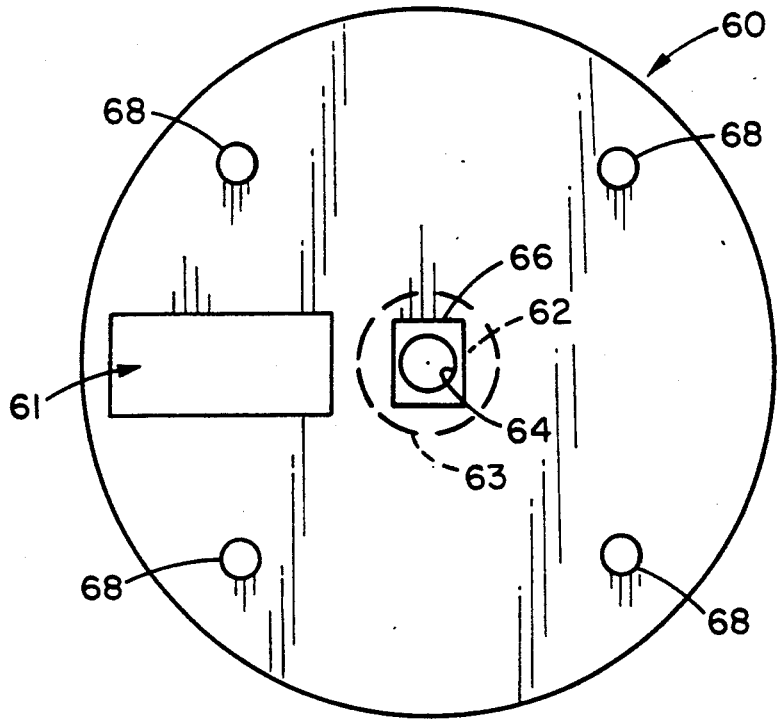
FIG. 6 is an enlarged sectional view taken on the line 6—6 of FIG. 2.
Figure 7:
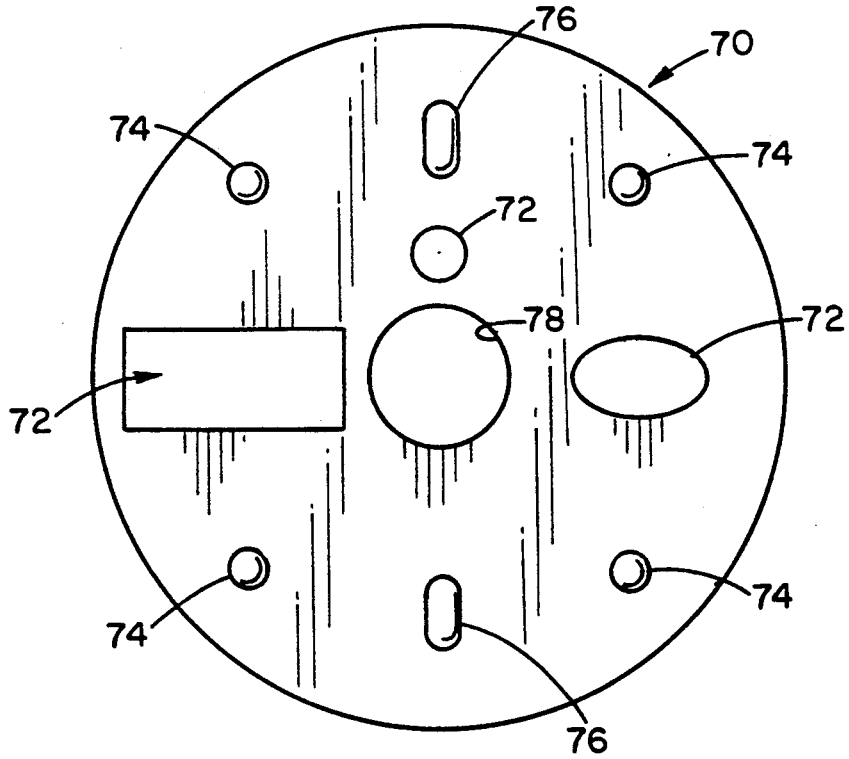
FIG. 7 is an enlarged sectional view taken on the line 7—7 of FIG. 2; and, FIG. 8 is a partial enlarged sectional view taken on the line 2—2 of FIG. 1, illustrating the flow patterns arising due to the nature of the spray nozzle configuration.

With continued reference to FIG. 2, but more particularly with reference to FIGS. 6 and 7 which illustrate views taken along line 6—6 and 7—7 of FIG. 2, respectively, the stationary disc 60 comprises an output orifice 61, a mushroomed center 62, a retainer ridge 63, an orientation clearance 64, a socket 66, and positioning holes 68. The output orifice 61 is selected to determine the absolute maximum size of the slurry communicating passage 54 for all conceivable applications of the spray nozzle. As can be seen in FIG. 2, the housing 11 is adapted to receive the stationary disc 60 over the fill passage wall 39 and up into the rim 14 past the internal threads 15. The stationary disc 60 is provided with an orientation clearance 64 through which the fill passage wall 39 extends. An integral socket 66 mates with a corresponding integral male part formed on the housing 11 to ensure that the stationary disc 60 is properly oriented. A mushroomed center 62 provides for easy manual manipulation of the stationary disc for removal or the like. The stationary disc itself is adapted to receive the movable disc 70 by means of a retainer ridge 63 and centering holes 68.

With the stationary disc 60 received into the housing 11 and oriented according to the orientation criteria established by the socket 66, the moveable disc 70 may then be installed into the housing 11 abutted against the stationary disc 60. The moveable disc 70 is provided with a plurality of outflow orifices 72, dimples 74, tabs 76, and an internal centering frictional surface 78. The dimples 74 are positioned about the moveable disc 70 to correspond with the positioning holes 68 provided in the stationary disc 60. As illustrated, the preferred embodiment comprises four hole/dimple sets, to provide for four individual orientations of the moveable disc 70 about an axis loosely defined by the fill passage 38. As can be seen from the FIGURES, the surface 78 is sized to frictionally engage the retainer ridge 63 and in this manner is held thereby during attachment of reservoir 16 to the spray nozzle. Actual control over the resultant size of the slurry communicating passage 54 is controlled by a combination of the output orifice 61 and selection of a one of the plurality of outflow orifices 72. As seen in the FIGURES, the outflow orifices 72 may be sized and numbered according to a wide variety of particular applications. That is, it is possible to provide a single large outflow orifice, or a plurality of small orifices, or any combination thereof, to achieve a desired slurry outflow characteristic.

However, it is to be noted that the spray nozzle 10, as illustrated, functions to disperse both soluble and non-soluble products from the reservoir even without the use of either the discs 60 or 70. As would be expected, of course, without the expedient of the discs 60, 70 to govern the flow of the concentrated product, soluble substances are expelled from the nozzle and applied over the desired surface rather quickly, as to make use of the device without the control provided by the discs 60, 70 to be unwise.

In operation, a single large outflow orifice is manually selected through use of tabs 76 by rotating the moveable disc 70 about the fill passage axis until the dimples 74 engage the positioning holes 68. In that orientation, a slurry comprising grass seed and water may be applied to a surface. A small outflow orifice 72 for spreading soluble products is possible by manually rotating the moveable disc 70 in quarter-turn increments where the dimples 74 mate with the positioning holes 68. Through this simple expedient, the spray nozzle is easily convertible in the field for use with both soluble and non-soluble products presented within the canister 16. In addition, both discs are easily removable for cleaning or the like.

Figure 3:
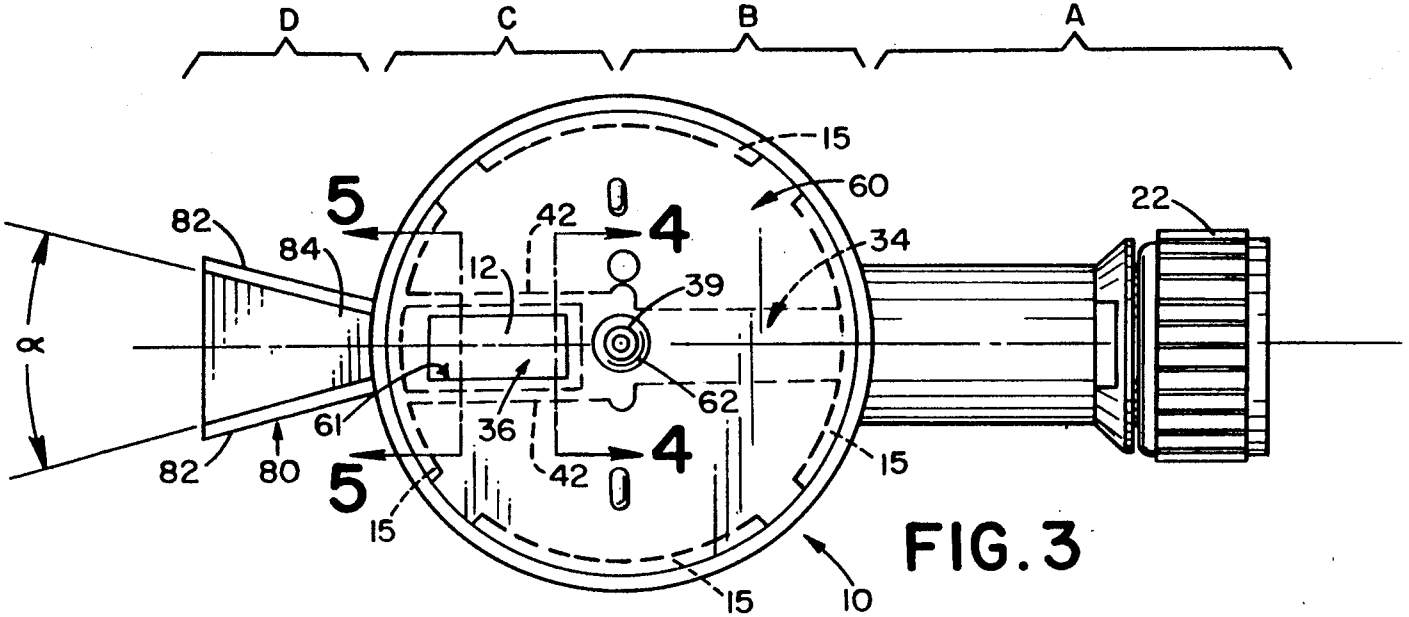
FIG. 3 is an enlarged sectional view taken on the line 3—3 of FIG. 2.

Referring next to FIG. 3, the spray nozzle of the preferred embodiment is illustrated with the moveable disc 70 removed. As can be seen in the FIGURE, the mixing chamber 36 is formed by a combination of mixing chamber walls 42, cover 12, and portions of the stationary disc 60. A passage into the mixing chamber is provided by the output orifice 61 of the stationary disc. Control over the size of the passage is possible with the moveable disc 70 as is described above.

With continued reference to FIG. 3, the exhaust end D of the spray nozzle comprises a flared nose so, having guide ribs 82, and a bottom surface 84. The guide ribs 82 are formed to be separated by a gap near the mixing chamber and to protrude forward at an angle from the mixing chamber such that the two ribs are separated by a greater gap at their tips furthest from the housing. The guide ribs forming the flared nose define an angle $\alpha$, which in the preferred embodiment is approximately 25°.

Figure 4:
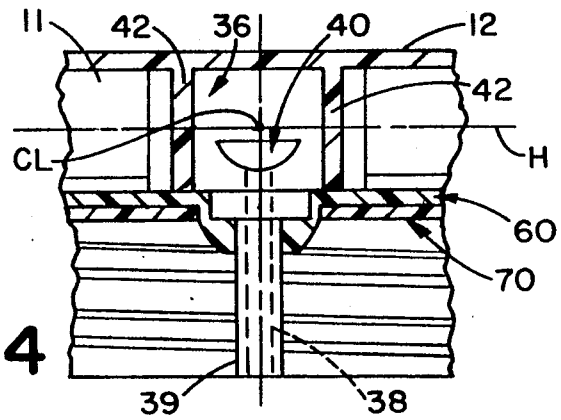
FIG. 4 is an enlarged sectional view taken on the line 4—4 of FIG. 3.
Figure 5:
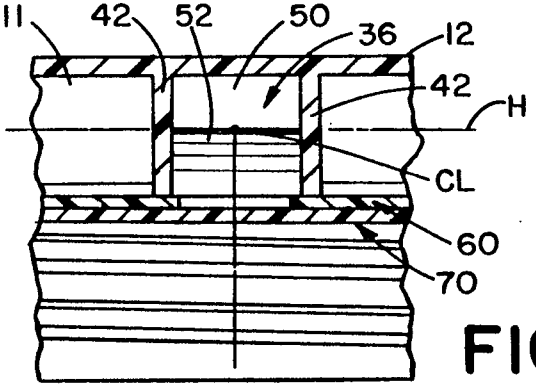
FIG. 5 is an enlarged sectional view taken on the line 5—5 of FIG. 3.

Referring next to FIGS. 4 and 5, taken on the lines 4—4 and 5—5 of FIG. 3, respectively, the unique positioning of the direct passage 40 and outlet channel 50 of the preferred embodiment will be described. Referring first to FIG. 4, a first end of the mixing chamber 36 is illustrated being formed in part by the cover 12, mixing chamber walls 42, and the housing 11. As can be seen in the FIGURE, the direct passage 40 is configured in a "half-moon" shape in the preferred embodiment. The direct passage 40 opens into the mixing chamber 36 below the longitudinal axis CL.

Referring next to FIG. 5, a second end of the mixing chamber 36 is shown being formed in part by the cover 12, the mixing chamber walls 42, and the housing 11. The outlet channel 50 provides an exhaust opening from the mixing chamber 36 above the longitudinal axis CL. Outlet channel deflector 52 extends away from the longitudinal axis CL a distance at least as large as that by which the direct passage 40 extends from the longitudinal axis CL, as illustrated in FIG. 4.

By the arrangement of the direct passage and outlet channel as described above, fluid exiting the secondary inlet chamber 34 through the direct passage 40 necessarily strikes the outlet channel deflector 52 formed to lie in a direct path distanced from and parallel with the longitudinal axis CL. A plane H is defined by the longitudinal axis CL illustrated in FIGS. 4 and 5 and substantially perpendicular with the fill passage 38. The direct passage 40 and the outlet channel 50 are constrained to lie on opposite sides of plane H.

Figure 8:
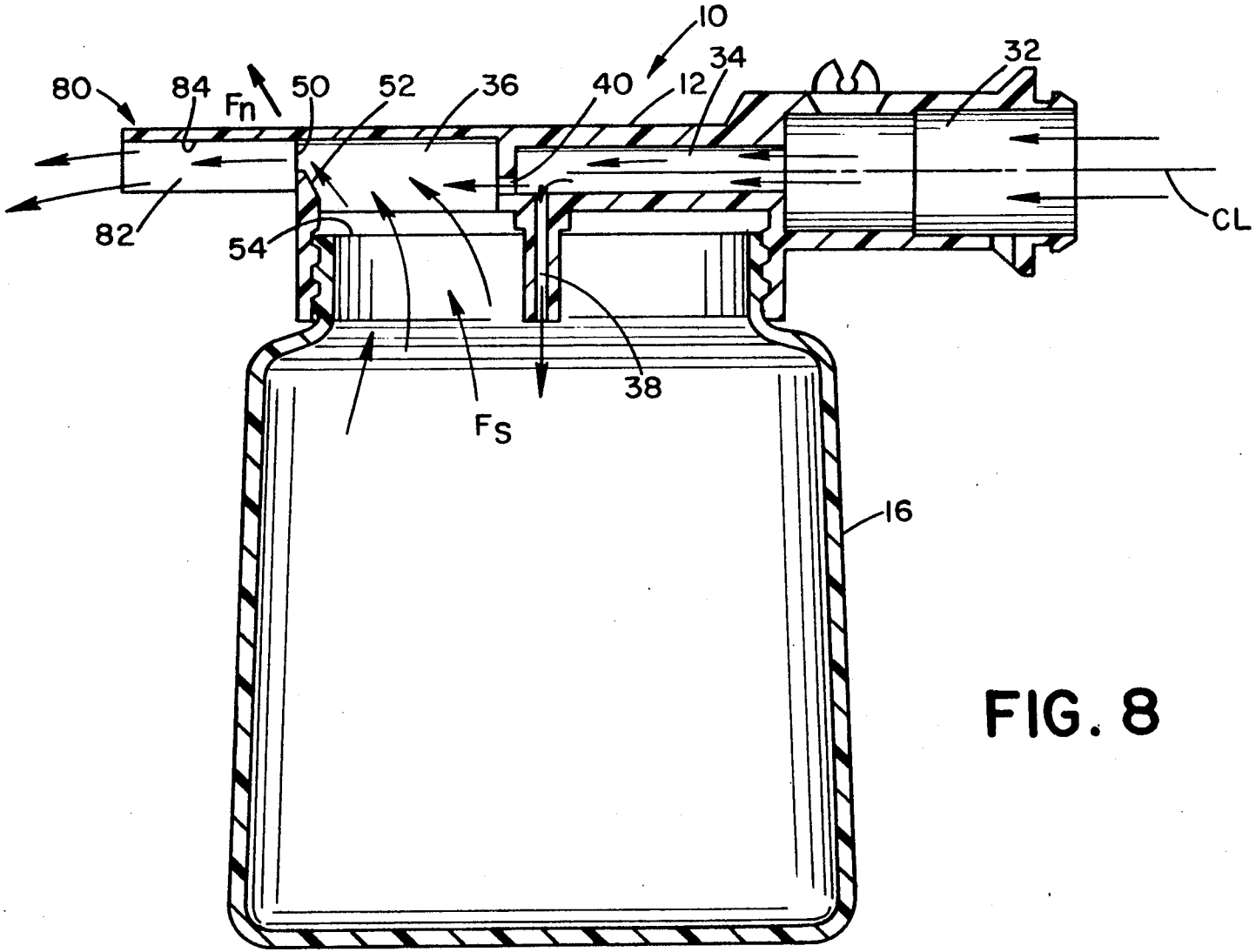

With reference next to FIG. 8, the general flow of fluids through the spray nozzle will be described with respect to the preferred embodiment. A first flow is received from a fluid supply source into the primary inlet chamber 32. From the primary inlet chamber 32, the first fluid enters a secondary inlet chamber 34, the inlet chambers being aligned on a common longitudinal axis CL. The fill passage 38 communicates a first portion of the first fluid from the secondary inlet chamber 34 into canister 16. The direct passage 40 communicates a second portion of the first fluid from the secondary inlet chamber 34 into the mixing chamber 36. The second portion of the first fluid is substantially directed by the direct passage against the outlet channel deflector 52. The movement of the second portion of the first fluid flow across the slurry communicating passage 54 draws the slurry into the mixing chamber 36 as a mixed composition flow $F_s$ according to the venturi effect.

The outlet channel deflector 52 creates a constant turbulence of the fluids in and near the mixing chamber 36. Some of the turbulence is due in part to flows from the mixing chamber 36 into reservoir 16. Overall, the turbulence performs at least two beneficial functions. First, the progress of the material from the reservoir 16 and out channel 50 is held in check for better control over the concentration of the material applied to the desired spray surface area. Also, the turbulence prevents a "bunching" up of non-soluble products within the mixing chamber 36 which would tend to clog the nozzle.

The mixture exiting mixing chamber 36 through outlet channel 50 is substantially directed by the reflected fluid flow from the outlet channel deflector 52. As such, the bottom surface 84 of the flared nose 80 provides a second reflecting surface against which the mixture exiting the spray nozzle is guided. Further, the guide ribs 82 comprising the flared nose 80 determine the "spread" of the mixture exiting the spray nozzle 10. This "doubly reflected" fluid flow according to the inherent misalignment between the direct passage 40 and the outlet channel 50 prevents clogging of the mixing chamber 36 and accommodates a uniform distribution of the expelled fluids.

Removal of the flared nose 80 results in a fluid exhaust substantially parallel to the plane defined by the surface 52. But for the nose 80, the expelled fluid flow would generally follow the direction illustrated as $F_N$.

The invention has been described with reference to the preferred embodiments. Obviously, modifications and alterations will occur to others upon a reading and understanding of the instant specification. It is my intention to include all such modifications and alterations in so far as they come within the scope of the appended claims or the equivalents thereof.

Having thus described the invention, I claim:

1. A spray nozzle apparatus adapted for use with a fluid supply source and a reservoir having an opening, the apparatus comprising:

a housing defining a mixing chamber therein;

means for coupling the reservoir to the housing at the opening;

input communicating means for communicating a supply of a first fluid from the fluid supply source into the housing through an elongate passageway having a substantially columnar first surface;

first passage means for communicating a first portion of the first fluid from the input communicating means into the reservoir as a mixing fluid flow;

second passage means for communicating the remaining portion of the first fluid from the input communicating means into the mixing chamber as a drawing fluid flow having a substantially columnar path, said second passage means being defined at least in part by said first surface;

fluid reflecting means for reflecting the drawing fluid flow and the mixing fluid flow as a first reflected fluid flow, the reflecting means being positioned substantially within the columnar path; and, outlet reflecting means for guiding the first reflected fluid flow into a spray pattern, said outlet reflecting means being offset from said columnar path.

2. The spray nozzle apparatus according to claim 1 further comprising restricting means for selectively restricting egress of the mixing fluid flow from the reservoir and into the mixing chamber.

3. The spray nozzle apparatus according to claim 1 wherein said outlet reflecting means comprises a flattened surface defining a plane substantially parallel to said columnar path.

4. The spray nozzle apparatus according to claim 3 wherein said outlet reflecting means further comprises at least two surfaces substantially perpendicular to said flattened surface and which are separated from each other by a distance which increases as the at least two surfaces extend away from said fluid reflecting means.

5. The spray nozzle apparatus according to claim 4 further comprising restricting means for selectively restricting egress of the mixing fluid flow from the reservoir and into the mixing chamber.

6. The spray nozzle apparatus according to claim 2 wherein the restricting means comprises an apertured disc means having a plurality of perforations of varying sizes for selectively controlling the mixing fluid flow communicated therethrough.

7. The spray nozzle apparatus according to claim 5 wherein the restricting means comprises an apertured disc means having a plurality of perforations of varying sizes therethrough for selectively controlling the mixing fluid flow communicated to the mixing chamber.

8. The spray nozzle apparatus according to claim 1 wherein said second passage means comprises a single orifice for directing the drawing fluid flow into the mixing chamber in a single substantially columnar path.

9. The spray nozzle apparatus according to claim 1 wherein said fluid reflecting means is positioned within the entire columnar path of the drawing fluid flow.

10. The spray nozzle apparatus according to claim 8 further comprising restricting means for selectively restricting egress of the mixing fluid flow from the reservoir and into the mixing chamber.

11. The spray nozzle apparatus according to claim 8 wherein said outlet reflecting means comprises a flattened surface defining a plane substantially parallel to said columnar path.

12. The spray nozzle apparatus according to claim 11 wherein said outlet reflecting means further comprises at least two surfaces substantially perpendicular to said flattened surface and which are separated from each other by a distance which increases as the at least two surfaces extend away from said fluid reflecting means.

13. The spray nozzle apparatus according to claim 12 further comprising restricting means for selectively restricting egress of the mixing fluid flow from the reservoir and into the mixing chamber.

14. The spray nozzle apparatus according to claim 10 wherein the restricting means comprises an apertured disc means having a plurality of perforations of varying sizes therethrough for selectively controlling the mixing fluid flow communicated to the mixing chamber.

15. The spray nozzle apparatus according to claim 13 wherein the restricting means comprises an apertured disc means having a plurality of perforations of varying sizes therethrough for selectively controlling the mixing fluid flow communicated to the mixing chamber.

16. A convertible spray applicator for use with a container having an opening for communication of a substance therein to the applicator, the applicator comprising:

a housing defining a mixing chamber therein;

a first end for receiving a first fluid flow into the applicator through an elongate passageway having a substantially columnar first surface;

first fluid communication means for communicating a first metered portion of the first fluid flow into said opening to mixedly combine with the substance as a slurry;

second fluid communication means for communicating the remaining portion of said first fluid flow into the mixing chamber as a drawing fluid flow in a substantially columnar path, said second fluid communication means being defined at least in part by said first surface;

third fluid communication means for communicating selectively metered portions of the slurry to said mixing chamber for combination with the drawing fluid flow forming a composite solution;

means positioned substantially within the columnar drawing fluid flow path for deflecting said composite solution as a first deflected fluid flow; and, outlet means having an exit orifice for discharging the composite solution.

17. The convertible spray applicator according to claim 16 wherein the third fluid communication means comprises:

a passageway between the container and the mixing chamber; and, control valve means for selective control of the cross-sectional area of said passageway.

18. The convertible spray applicator according to claim 17 wherein the control valve means comprises an apertured disc having a plurality of perforations of varying sizes.

19. The convertible spray applicator according to claim 18 wherein the apertured disc is manually rotatable about an axis of said first fluid communication means.

20. The convertible spray applicator according to claim 17 wherein the control valve means comprises: i) a stationary disc having at least one orifice positionable adjacent said passageway, and ii) a selectively rotatable disc adjacent said stationary disc, the rotatable disc having a plurality of orifices for selectively communicating predetermined portions of said slurry through said stationary disc.

21. The convertible spray applicator according to claim 20 further comprising:

outlet deflecting means for guiding the first deflected fluid flow into a spray pattern.

22. The convertible spray applicator according to claim 21 wherein said outlet deflecting means comprises:

a flattened surface defining a plane substantially parallel to said columnar drawing fluid flow; and, at least two surfaces substantially perpendicular to said flattened surface and which are separated from each other by a distance which increases as the at least two surfaces extend away from said means for deflecting the composite solution.

23. The convertible spray applicator according to claim 16 wherein said second fluid communicating means comprises a single orifice for directing the drawing fluid flow into the mixing chamber as a single substantially columnar fluid flow.

24. The convertible spray applicator according to claim 16 wherein said means for reflecting the composite solution extends to the entire columnar path of the drawing fluid flow.

25. The convertible spray applicator according to claim 23 wherein the third fluid communication means comprises:

a passageway between the container and the mixing chamber; and, control valve means for selective control of the cross-sectional area of said passageway.

26. The convertible spray applicator according to claim 25 wherein the control valve means comprises an apertured disc having a plurality of perforations of varying sizes.

27. The convertible spray applicator according to claim 25 wherein the control valve means comprises: i) a stationary disc having at least one orifice positionable adjacent said passageway, and ii) a selectively rotatable disc adjacent said stationary disc, the rotatable disc having a plurality of orifices for selectively communicating predetermined portions of said slurry through said stationary disc.

28. The convertible spray applicator according to claim 26 wherein the apertured disc is manually rotatable about an axis of said first fluid communication means.

29. The convertible spray applicator according to claim 27 further including outlet deflecting means comprising:

a flattened surface defining a plane substantially parallel to said columnar fluid flow; and, at least two surfaces substantially perpendicular to said flattened surface and which are separated from each other by a distance which increases as the at least two surfaces extend away from said fluid reflecting means.

30. In a spray nozzle apparatus adapted to use with a fluid supply source, a reservoir having an opening, a housing defining a mixing chamber therein, coupling means for coupling the reservoir to the housing at the opening, input communicating means for communicating a supply of a first fluid from the fluid supply source into the housing through an elongate passageway having a substantially columnar first surface, fill passage means for dividing the first fluid into first and second portions and communicating the first portion from the input communicating means into the reservoir creating a slurry therein, and slurry communicating means in the housing for communicating the slurry into the mixing chamber, the improvement comprising:

direct passage means for communicating the second portion of said first fluid into the mixing chamber from the input communicating means as a substantially columnar drawing fluid flow, the drawing fluid flow defining a columnar path with a longitudinal axis and having a cross sectional area transverse the longitudinal axis substantially defined by the size of the direct passage means, said direct passage means being defined at least in part by said first surface;

outlet channel deflector means in at least a portion of said cross sectional area defined by the columnar path for deflecting the drawing fluid flow as a deflected fluid flow; and, outlet channel passage means for communicating the deflected fluid flow and the slurry from the mixing chamber.

31. The improved spray nozzle apparatus according to claim 30 further comprising means for selectively throttling the communication of said slurry through the slurry communicating means and into the mixing chamber.

32. A spray nozzle apparatus adapted for use with a fluid supply source and a reservoir having an opening, the apparatus comprising:

a housing defining a mixing chamber therein;

means for coupling the reservoir to the housing at the opening;

input communicating means for communicating a supply of a first fluid from the fluid supply source into the housing through an elongate passageway having a substantially columnar first surface;

first passage means for communicating a first portion of the first fluid from the input communicating means into the reservoir as a mixing fluid flow;

second passage means for communicating the remaining portion of the first fluid from the input communicating means into the mixing chamber as a drawing fluid flow having a substantially columnar path, said second passage means being defined at least in part by said first surface;

slurry passage means for selectively restricting egress of the mixing fluid flow from the reservoir and into the mixing chamber as a mixed slurry;

fluid reflecting means for reflecting the drawing fluid flow and the mixed slurry as a first reflected fluid flow, the reflecting means being positioned within at least a portion of said columnar path;

outlet passage means having a cross section smaller than that of the slurry passage means and larger than that of the second passage means for communicating the first reflected fluid flow from the housing; and, outlet reflecting means, offset from said columnar path, for guiding the first reflected fluid flow into a spray pattern downstream of said outlet passage means.

33. The spray nozzle apparatus according to claim 32 wherein said second passage means comprises a single orifice for directing the drawing fluid flow into the mixing chamber as a single substantially columnar path.

34. The spray nozzle apparatus according to claim 33 wherein the slurry passage means comprises an apertured disc means having a plurality of perforations of varying sizes therethrough for selectively controlling the mixing fluid flow communicated to the mixing chamber.

* * * * *